United States Patent [19]

Kelly

[11] Patent Number: 4,537,341

[45] Date of Patent: Aug. 27, 1985

[54] NURSING BOTTLE HOLDER

[76] Inventor: Oscar Kelly, 1834 Lencar Way, San Jose, Calif. 95124

[21] Appl. No.: 637,118

[22] Filed: Aug. 2, 1984

[51] Int. Cl.[3] ..... A61J 9/06

[52] U.S. Cl. ..... 224/202; 224/148; 248/104

[58] Field of Search ..... 224/901, 202, 206, 257, 224/254, 258, 260, 266, 265, 148; 248/102, 104

[56] References Cited

U.S. PATENT DOCUMENTS

| | | | |
|---|---|---|---|
| 2,494,632 | 1/1950 | Rodin | 248/102 |
| 2,907,539 | 10/1959 | Vardan | 248/104 |
| 2,938,693 | 5/1960 | Vardan | 248/104 |
| 3,564,590 | 2/1971 | Hebel | 224/264 X |
| 3,796,357 | 3/1974 | Johnson | 224/206 |
| 3,893,604 | 7/1975 | Skinner | 224/257 |
| 3,977,638 | 8/1976 | Woodard | 224/202 X |
| 4,220,302 | 9/1980 | Hampton et al. | 224/901 X |
| 4,337,938 | 7/1982 | Rodriguez | 224/258 X |
| 4,403,366 | 9/1983 | Lucke | 224/901 X |

*Primary Examiner*—Stephen Marcus
*Assistant Examiner*—Robert Petrik
*Attorney, Agent, or Firm*—Paul L. Hickman

[57] ABSTRACT

A nursing bottle holder characterized by an elongated, flexible strip of material which is draped around the neck of an infant's attendant. A pair of elastic straps are attached to one end of the strip and are provided with cooperating attachment members which allow them to be formed into a loops adapted to hold a nursing bottle. A counterweight is attached to the other end of the strap to prevent the weight of the bottle from pulling the flexible strip from around the attendant's neck. The position of the counterweight can be changed so as to adjust the height and position of the nursing bottle. An optional towel support may be provided to attach a small towel to the strap.

4 Claims, 5 Drawing Figures

NURSING BOTTLE HOLDER

BACKGROUND OF THE INVENTION

1. Field of the Invention

This invention relates generally to slings and the like, and more particularly to devices designed to support a nursing bottle.

2. Description of the Prior Art

The difficulty of simultaneously holding and feeding an infant with a nursing bottle has long been recognized. For example, in U.S. Pat. No. 2,500,846 of McFarland, a device including a flexible casing for receiving a nursing bottle, and a strap secured to the casing to encircle the neck of the infant's attendant is described. The step and flexible casing cooperate to form a continuous loop around the attendant's neck to hold the bottle securely in position.

Similar nursing bottle holders are found in U.S. Pat. Nos. 3,065,944 of Lievendorfer, 3,197,099 of Doba, 3,365,153 of Baucom, and 3,977,638 of Woodard. All of the above identified nursing bottle holders include a strap which forms a continuous loop around the attendant's neck, and means attached to the looped strap for holding a nursing bottle. This arrangement has several disadvantages including the difficulty of attaching and detaching the strap from around the neck, and the difficulty of adjusting the position of the nursing bottle during feeding.

SUMMARY OF THE INVENTION

An object of this invention is to provide a nursing bottle holder which is easily placed and removed from around an attendant's neck.

Another object of this invention is to provide a nursing bottle holder which can be quickly and easily adjusted to change the position of the nursing bottle.

Yet another object of this invention is to provide a nursing bottle holder which may used to hold a towel.

Briefly, the invention comprises an elongated, flexible strip which hangs around the neck of an infant's attendant; an elastic, adjustable loop attached to one of the free ends of the flexible strip; and a counterweight attached to the other end of the flexible strip. As an option, a towel supporting assembly can be attached near one of the ends of the strip.

An advantage of this invention is that the flexible strip is draped over the attendant's neck and does not need to be joined together to form a loop in order to securely hold a nursing bottle in position. This allows the nursing bottle holder to be quickly placed in position and subsequently removed.

Another advantage of this invention is that the counterweight allows the position of the flexible strip to be quickly changed so that the height of the nursing bottle can be varied.

Yet another advantage of this invention is that the towel support allows the infant's attendant immediate access to a towel, should the need arise.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
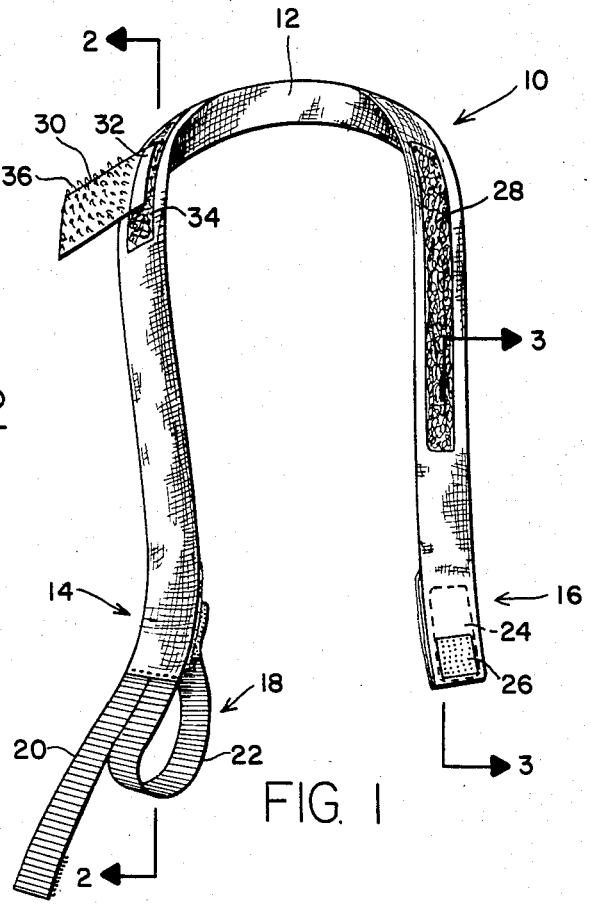
FIG. 1 is a perspective view of a nursing bottle holder in accordance with the present invention.

Referring to FIG. 1, a nursing bottle holder 10 in accordance with the present invention includes an elongated, flexible strip 12 having a first end portion 14 and a second end portion 16. The strip is preferably made from a soft, pliable textile material, but any suitably strong and flexible material such as plastic could also be used.

Attached to first end portion 14 of strip 12 is a bottle holding assembly 18 including a first strap 20 and a second strap 22. Strap 20 and 22 are preferably made from an elastic fabric material.

A counterweight 24 is attached to second end 16 of strip 12. The purpose of weight 24 is to counterbalance the weight of a nursing bottle engaged with bottle holding assembly 18.

Second end 16 is also provided with first cooperating member 26 which is engagable with a second cooperating member 28 that is attached to the surface of strip 12. As will be discussed in greater detail with reference to FIG. 4, cooperating members 26 and 28 permit the position of weight 24 to be varied.

Nursing bottle holder 10 may be also optionally provided with a towel supporting member 30 which is attached to strip 12 with a first cooperating member 32 and a second cooperating member 34. At least a portion of the outer surface of towel supporting member 30 is provided with a towel engaging member such as hooks 36.

Figure 2:
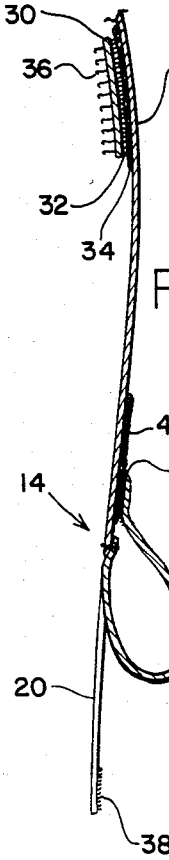
FIG. 2 is a cross-sectional view taken along line 2—2 of FIG. 1.

Referring now to FIG. 2, straps 22 and 24 are attached to the end 14 of strip 12 such as by sewing, riveting, etc. The free ends of straps 22/24 are provided with first cooperating member 38 which are releasably engagable with a second cooperating member 40 attached to the rear surface of strip 12. Elastic straps 22/24 are in their operational position when they are formed into a loop as illustrated with respect to strap 22.

Still with reference to FIG. 2, towel supporting member 30 is made from a relatively stiff material so that it maintains its shape as it is cantilevered from its attachment to strip 12. Hooks 36 are of sufficient size to engage with the nap or loops of a standard terry cloth towel such that it is removably engagable with towel support member 30.

Figure 3:
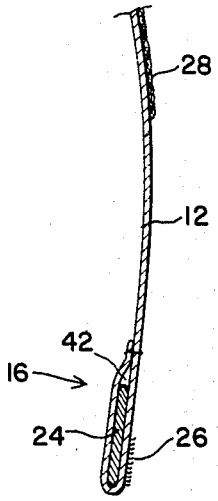
FIG. 3 is a cross-sectional view taken along line 3—3 of FIG. 1.

Referring now to FIG. 3, end 16 of strip 12 is folded back on itself to provide a space 42 within which a counterweight 24 may be located. The edges of the folded back portion of second end 16 are preferably sewn together to secure counterweight 24 within space 42.

Figure 4:
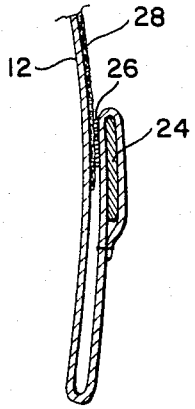
FIG. 4 shows the portion of the nursing bottle holder depicted in FIG. 3 in one of its adjustment positions.

First cooperating member 26 is attached to end 16 of strip 12 by any suitable member, and second cooperating member 28 is likewise attached to a midlength portion of strip 12. As seen in FIG. 4, first cooperating member 26 may be engaged with a portion of second cooperating member 28 so that the position of counterweight 24 may be varied. This is to allow the length of strip 12 and the position of counterweight 24 to be varied so that the nursing bottle held by the bottle holding assembly 18 can be comfortably adjusted for both the infant and the attendant.

Figure 5:
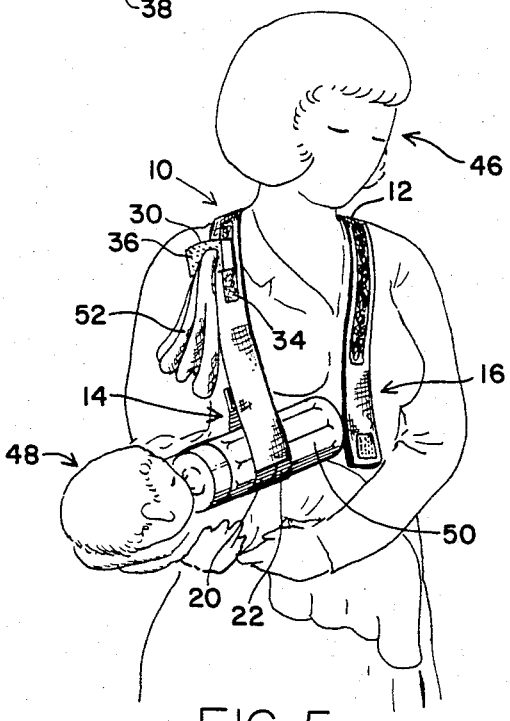
FIG. 5 is a perspective view illustrating the use of the nursing bottle holder.

With reference to FIG. 5, an attendant 46 for an infant 48 drapes the strip 12 of the nursing bottle holder around her neck as shown. It should be noted that the ends 14 and 16 of strip 12 are not joined together to form a loop, and thus the nursing bottle holder 10 can be easily removed.

A nursing bottle 50 is engaged with the straps 20 and 22, and second end 16 is gently pulled upon until the bottle 50 is in a comfortable position for both the attendant 46 and infant 48. If end 16 is hanging down too far to be comfortable, first cooperating member 26 can be engaged with second cooperating member 28 to shorten end 16 of the strap.

First cooperating member 32 of towel supporting member 30 may be engaged with second cooperating member 34, and a terry cloth towel 52 may be engaged with hooks 36 of towel supporting member 30. Should the need arise, the towel 52 can be easily pulled from hooks 36.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A nursing bottle holder comprising:

(a) an elongated, flexible strip having a first end portion and a second end portion, said strip being adapted to be draped around an attendant's neck with said first end portion and said second end portion hanging substantially parallel to each other along said attendant's upper torso, said first end portion and said second end portion being unattached to each other;

(b) bottle holding means provided at said first end portion of said strip, said bottle holding means including a pair of spaced apart fastener means attached to said first end portion such that said pair of fastener means can be engaged to form a loop at said first end portion, said loop being engagable with the circumference of a nursing bottle; and (c) counterbalance means provided at said second end portion of said strip, said counterbalance means including a counterbalance weight attached to said second end portion, said counterbalance means further including a pair of cooperating fastener means attached to said second end portion such that said second end portion may be formed into a loop to vary the position of said counterbalance weight and to shorten the overall extension of said strip.

2. A nursing bottle holder as recited in claim 1 wherein said flexible strip is doubled proximate said second end portion such that said weight is attached within said flexible strip at said second end portion.

3. A nursing bottle holder as recited in claim 1 wherein said bottle holding means includes a pair of elastic straps each affixed by their ends to said first first end portion of said strip, a first fastener means attached to the remaining ends of said elastic straps, and a second fastener means attached to said strap, such that the engagement of said first fastener means and said second fastener means forms said pair of elastic straps into an expansible loop engagable with the circumference of a nursing bottle.

4. A nursing bottle holder as recited in claim 1 further comprising towel supporting means including a base portion, means for attaching said base portion to one of said first end portion and said second end portion, and towel engagement means including a plurality of hooks engagable with the nap of a towel, said towel engagement means being attached to said base portion, wherein said means for attaching said base portion includes a first type of fastener attached to at least one of said one said first end portion and said second end portion, and a second type of fastener attached to said base portion and removably engagable with said first type of fastener.

* * * * *